US008950176B2

(12) United States Patent
Uzkan et al.

(10) Patent No.: US 8,950,176 B2
(45) Date of Patent: Feb. 10, 2015

(54) SYSTEM FOR REDUCING ENGINE EMISSIONS AND BACKPRESSURE USING PARALLEL EMISSION REDUCTION EQUIPMENT

(75) Inventors: Teoman Uzkan, Indian Head Park, IL (US); Thomas Gallagher, Plainfield, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 266 days.

(21) Appl. No.: 13/485,348

(22) Filed: May 31, 2012

(65) Prior Publication Data

US 2013/0000277 A1 Jan. 3, 2013

Related U.S. Application Data

(60) Provisional application No. 61/502,610, filed on Jun. 29, 2011.

(51) Int. Cl.

| | |
|---|---|
| ***F01N 3/10*** | (2006.01) |
| ***F01N 3/00*** | (2006.01) |
| ***F01N 13/04*** | (2010.01) |
| ***F02D 41/00*** | (2006.01) |
| ***F02D 41/30*** | (2006.01) |
| ***F01N 13/00*** | (2010.01) |

(Continued)

(52) U.S. Cl.

CPC ..... *F01N 13/04* (2013.01); *F02D 41/0087* (2013.01); *F02D 41/3058* (2013.01); *F01N 13/017* (2013.01); *F01N 13/0097* (2013.01); *F01N 3/035* (2013.01); *F01N 3/103* (2013.01); *F01N 3/2066* (2013.01); *F01N 3/021* (2013.01); *F01N 2590/08* (2013.01)

USPC ..... 60/302; 60/287

(58) Field of Classification Search

CPC ..... F01N 13/04

USPC ..... 60/280–282, 287, 291, 297, 302, 313, 60/323

See application file for complete search history.

(56) References Cited

U.S. PATENT DOCUMENTS 4,709,547 A * 12/1987 Pischinger et al. ..... 60/274
4,887,427 A * 12/1989 Shinzawa et al. ..... 60/286

(Continued)

FOREIGN PATENT DOCUMENTS

DE 19957715 C2 * 1/2002
DE 102010002606 A1 * 9/2011

(Continued)

*Primary Examiner* — Thomas Denion
*Assistant Examiner* — Mickey France
(74) *Attorney, Agent, or Firm* — Finnegan, Henderson, Farabow, Garrett & Dunner LLP

(57) ABSTRACT

An exhaust emission reduction system for a fuel injected engine system has a plurality of emission reduction components configured to process the exhaust gas. The emissions reduction components include of one or more $NO_X$ reduction components and one or more filtration components configured to reduce particulate matter, hydrocarbons and/or carbon monoxide emissions. Each engine cylinder is associated with a respective one of the emission reduction components, such that exhaust gas from each engine cylinder flows through the respective one emission reduction component in parallel with the exhaust gas flows from the other cylinders through their respective emission reduction components.

20 Claims, 7 Drawing Sheets

(51) Int. Cl.

| | |
|---|---|
| *F01N 3/035* | (2006.01) |
| *F01N 3/20* | (2006.01) |
| *F01N 3/021* | (2006.01) |

(56) References Cited

U.S. PATENT DOCUMENTS

| | | | | |
|---|---|---|---|---|
| 5,553,575 | A * | 9/1996 | Beck et al. | 123/198 F |
| 5,701,736 | A * | 12/1997 | Morishima et al. | 60/297 |
| 5,930,995 | A * | 8/1999 | Watanabe et al. | 60/311 |
| 5,941,066 | A * | 8/1999 | Araki et al. | 60/280 |
| 8,166,750 | B2 * | 5/2012 | Bruck | 60/297 |
| 8,291,699 | B2 * | 10/2012 | Payri Gonzalez et al. | 60/323 |
| 2002/0162325 | A1 * | 11/2002 | Kato et al. | 60/297 |
| 2002/0189247 | A1 * | 12/2002 | Kato et al. | 60/297 |
| 2002/0194844 | A1 * | 12/2002 | Shiratani et al. | 60/297 |
| 2003/0014967 | A1 * | 1/2003 | Daetz et al. | 60/285 |
| 2006/0080953 | A1 * | 4/2006 | Maus et al. | 60/286 |
| 2008/0009997 | A1 * | 1/2008 | Ketterer et al. | 701/101 |
| 2008/0202107 | A1 * | 8/2008 | Boorse et al. | 60/301 |
| 2008/0229734 | A1 * | 9/2008 | Girondi | 60/299 |
| 2008/0241032 | A1 * | 10/2008 | Zuberi | 423/235 |
| 2009/0094966 | A1 * | 4/2009 | Huslig | 60/302 |
| 2010/0043751 | A1 * | 2/2010 | Kweon et al. | 123/435 |

FOREIGN PATENT DOCUMENTS

| | | | |
|---|---|---|---|
| JP | 09268910 | A * | 10/1997 |
| JP | 2012159054 | A * | 8/2012 |

* cited by examiner

SYSTEM FOR REDUCING ENGINE EMISSIONS AND BACKPRESSURE USING PARALLEL EMISSION REDUCTION EQUIPMENT

Applicants hereby claim priority to Provisional Application No. 61/502,610, filed Jun. 29, 2011, the entire content of which is hereby incorporated by reference.

TECHNICAL FIELD

The present disclosure relates generally to the field of exhaust emission reduction for internal combustion engines. More specifically, the present disclosure relates to systems for reducing one or more of particulate, hydrocarbon, carbon monoxide, and $NO_X$ exhaust emissions.

BACKGROUND

As depicted in FIGS. 1A-1C, in conventional turbocharged locomotive two-stroke diesel engine systems 101 having an air/exhaust system 103, the turbocharger 100 draws air from the atmosphere 116, which is filtered using a conventional air filter 118. The filtered air is compressed by a compressor 102. The compressor 102 is powered by a turbine 104, as will be discussed in further detail below. A larger portion of the compressed air (or "charge air") is transferred to an aftercooler (or otherwise referred to as a heat exchanger, charge air cooler, or intercooler) 120 where the charge air is cooled to a select temperature. Another smaller portion of the compressed air is transferred to a crankcase ventilation oil separator 122, which evacuates the crankcase 114 in the engine; entrains crankcase gas; and filters entrained crankcase oil before releasing the mixture of crankcase gas and compressed air into the atmosphere 116.

As best seen in FIG. 1A, the cooled charge air from the aftercooler 120 enters the engine 106 via an airbox 108. The decrease in charge air intake temperature provides a denser intake charge to the engine, which reduces $NO_X$ emissions while improving fuel economy. The airbox 108 is a single enclosure, which distributes the cooled air to a power assembly 110 including a plurality of cylinders 125 arranged in two banks 127*a*, 127*b*. Each of the cylinders 125 is closed by a cylinder head 126. As best seen in FIG. 1B, fuel injectors 121 in the cylinder heads 126 introduce fuel into each of the cylinders 125 where the fuel is mixed and combusted with the cooled charge air. Each cylinder 125 includes a piston 128 which transfers the resultant force from combustion to the crankshaft 130 via a connecting rod 132. Each piston 128 includes a piston bowl, which facilitates mixture of fuel and trapped gas (including cooled charge air) necessary for combustion. The cylinder heads 126 include exhaust ports controlled by exhaust valves 134 mounted in the cylinder heads 126, which regulate the amount of exhaust gases expelled from the cylinders 125 after combustion.

The combustion cycle of a diesel engine includes, what is referred to as, scavenging and mixing processes. During the scavenging and mixing processes, a positive pressure gradient is maintained from the intake port of the airbox 108 to the exhaust manifold 112 such that the cooled charge air from the airbox 108 charges the cylinders and scavenges most of the combusted gas from the previous combustion cycle. More specifically, during the scavenging process in the power assembly 110, the cooled charge air enters one end of a cylinder 125 through intake port 135 controlled by an associated piston 128. (see FIG. 1B). The cooled charge air mixes with a small amount of combusted gas remaining from the previous cycle. At the same time, the larger amount of combusted gas exits the other end of the cylinder via four exhaust valves and enters the exhaust manifold 112 along paths 136 as exhaust gas. The control of these scavenging and mixing processes is instrumental in emissions reduction, as well as in achieving desired levels of fuel economy.

Exhaust gases from the combustion cycle exit the engine 106 via an exhaust manifold 112. The exhaust gas flow from the engine 106 is used to power the turbine 104 and thereby power the compressor 102 of the turbocharger 100. After powering the turbine 104, the exhaust gases are released into the atmosphere 116 via an exhaust stack 124 or silencer.

The exhaust gases released into the atmosphere by internal combustion engines such as the locomotive diesel engine system in FIGS. 1A-1C include particulates, nitrogen oxides ($NO_X$) and other pollutants such as hydrocarbon and carbon monoxide. Legislation has been passed to reduce the amount of pollutants that may be released into the atmosphere. Traditional systems have been implemented which reduce these pollutants, but at the expense of fuel efficiency.

Emissions reduction systems have previously been employed to reduce NOx and particulate matter (PM), hydrocarbon (HC), and/or carbon monoxide (CO) emissions in a series flow arrangement. That is, the exhaust gas stream first passes through a $NO_X$ emission reduction unit and then a filtration unit for PM/HC/CO reduction (or vice versa). In such systems, the emissions reduction equipment also is applied to the exhaust gas from all cylinders of the engine collectively. As a result, the backpressure of the turbine 104 generally increases, thereby causing the pressure to drop at the system components. Because the system components are installed in series, the total pressure drop is the summation of the pressure drop of each of these components.

Because of the increase in backpressure, the expansion of gases in the cylinder and at the turbine is reduced, which causes a reduction in the power level obtained from the cylinder and turbine 104 and affects the scavenging and mixing processes in a two-stroke engine. Also, the turbine 104 cannot deliver enough power to the compressor 102, which reduces the turbocharger 100 speed and the amount of air supplied to engine 106. As a result, the amount of fuel that may be burned effectively in the cylinders is reduced, causing further power reduction of the engine 106. Therefore, when the conventional exhaust emission reduction equipment is added to the engine 106, engine power is reduced; engine fuel consumption is increased; and, scavenging and mixing desired in the two-stroke engine is affected. Therefore, there is a need for an airflow system that reduces PM/HC/CO and NOx emissions without significantly increasing backpressure.

The various embodiments of the presently disclosed system may be able to exceed one or more of what is referred in the industry as, the Environmental Protection Agency's (EPA) Tier II (40 CFR 92), Tier III (40 CFR 1033), and Tier IV (40 CFR 1033) emission requirements, as well as the European Commission (EURO) Tier Mb emission requirements.

Locomotives must also be able to operate within specific length, width, and height constraints. For example, the length of the locomotive must be below that which is necessary for it to negotiate track curvatures or a minimum track radius. In another example, the width and height of the locomotive must be below that which is necessary for it to clear tunnels or overhead obstructions. Locomotives have been designed to utilize all space available within these size constraints. Therefore, locomotives have limited space available for adding new system components thereon. Accordingly, there is a need to provide a system for reducing emissions and backpressure, the components of which may integrated within the limited size constraints of the locomotive and preferably within the same general framework of an existing locomotive. There is still further a need for a system for reducing emissions and backpressure, which system may operate in a locomotive operating environment.

SUMMARY OF THE DISCLOSURE

In accordance with an aspect of the present disclosure, an exhaust emission reduction system for an internal combustion engine system has a power assembly, with a plurality of cylinders and each cylinder having an inlet for receiving air for combustion with fuel within the cylinder and an exhaust for discharging exhaust gas resulting from combustion. The emission reduction system includes a plurality of emission reduction components configured to process the exhaust gas. The emissions reduction components include one or more $NO_X$ reduction components and one or more filtration components configured to reduce particulate matter, hydrocarbons and/or carbon monoxide emissions. Each engine cylinder is associated with a respective one of the emission reduction components, such that exhaust gas from each engine cylinder flows through the respective one emission reduction component in parallel with the exhaust gas flows from the other cylinders through their respective emission reduction components.

In accordance with a further aspect of the present disclosure, a method is provided of reducing engine exhaust emissions in an internal combustion engine having a plurality of cylinders for combusting fuel with air, the combustion producing exhaust gases. One or more components are provided for reducing $NO_X$ emissions and one or more filtration components are provided for reducing particulate matter, hydrocarbon, and/or carbon monoxide emissions in the exhaust gases. The method includes associating each of the $NO_X$ reducing and filtration components in a parallel flow arrangement to receive a flow of exhaust gases from a respective cylinder. The method still further includes treating the received flows of exhaust gases from the cylinders with the respective emission reducing components.

DETAILED DESCRIPTION OF THE DISCLOSED EMBODIMENTS

Figure 2A:
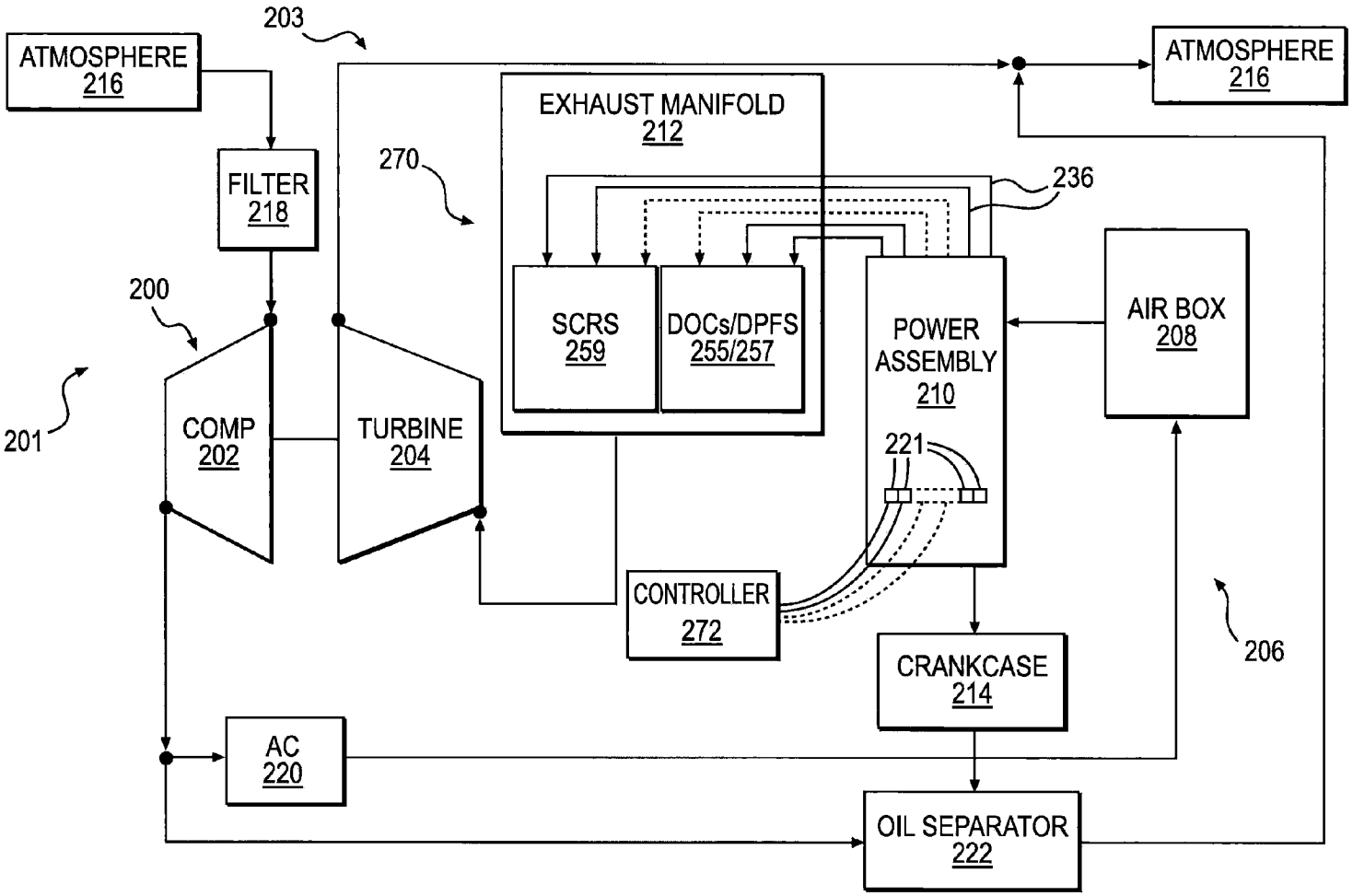
FIG. 2A is a system air/exhaust diagram of the two-stroke diesel engine system of FIG. 1A-1C modified to include the present exhaust emission reduction system.
Figure 2B:
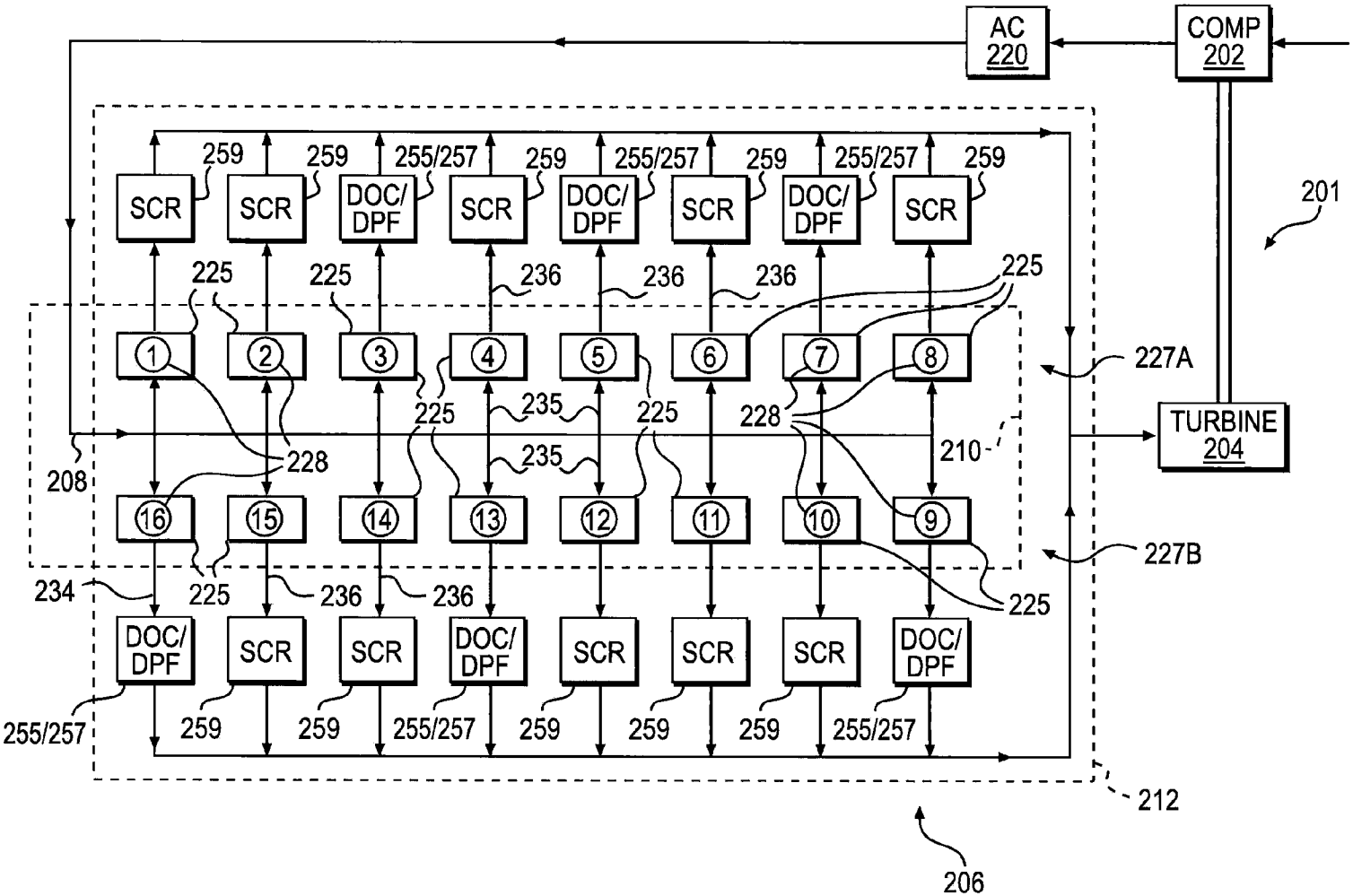
FIG. 2B is a detailed diagram showing a pattern for associating specific emission control components with the cylinder, within the exhaust manifold of the engine of the two-stroke diesel engine system of FIG. 2A.

FIGS. 2A and 2B, schematically illustrate the presently disclosed exhaust emission reduction system including an engine system 201 including a turbocharger 200 having a compressor 202 for compressing air received from filter 218, and being driven by exhaust gases via turbine 204 in gas air/exhaust system 203. See FIG. 2A. Engine system 201 includes an engine 206 with two cylinder banks 227*a*, 227*b*, each having a plurality of cylinders 225 and associated pistons 228 reciprocable within the cylinders 225, as part of power assembly 210. The combustion cycle of a diesel engine includes, what is referred to as, scavenging and mixing processes. During the scavenging and mixing processes, a positive pressure gradient is maintained from airbox 208 through power assembly 210, and to the exhaust manifold 212 such that the cooled charge air from the airbox 208 charges the cylinders and scavenges most of the combusted gas from the previous combustion cycle. More specifically, during the scavenging process in the power assembly 210, the charge, which may be cooled by after cooler 220 air, enters one end of a cylinder 225 controlled by an associated piston 228. The cooled charge air mixes with a small amount of combusted gas remaining from the previous cycle. At the same time, the larger amount of combusted gas exits the other end of the cylinder 225 via four exhaust valves and enters the exhaust manifold 212 as exhaust gas. The control of these scavenging and mixing processes is instrumental in emissions reduction as well as in achieving desired levels of fuel economy.

As illustrated in FIG. 2B, the engine 206 may be adapted to have a system 270 to provide reduced $NO_X$ and/or particulate, hydrocarbon, and/or carbon monoxide emissions, before releasing the exhaust to atmosphere 216. Specifically, the scavenging and mixing processes may be optimized to reduce $NO_X$ and/or particulate/hydrocarbon/carbon monoxide (hereinafter collectively "PM") emissions to a desired level. In order to reduce $NO_X$ and PM from the exhaust, the present system generally includes a $NO_X$ component and a PM filtration component integrated within engine 206. In the embodiment schematically depicted in FIGS. 2A and 2B, the $NO_X$ reduction system and filtration system are located within the exhaust manifold 212. The $NO_X$ reduction system is comprised of a plurality of selective catalytic reduction ("SCR") catalysts 259, and the PM filtration system is comprised of a plurality of diesel oxidation catalysts ("DOC") 255 and diesel particulate filters ("DPF") 257 to filter exhaust from the cylinders. In one embodiment, the DPF 257 may be in the form of a catalyzed partial flow diesel particulate filter. The DOC 255 uses an oxidation process to reduce the particulate matter, hydrocarbons and/or carbon monoxide emissions in the exhaust gases. The catalyzed partial flow DPF 257 includes a filter to reduce PM and/or soot from the exhaust gases. The DOC/DPF 255/257 arrangement also may be adapted to passively regenerate and oxidize soot therein. Although a DOC 255 and DPF 257 are shown, other comparable filters may be used. For example, a catalyzed diesel particulate filter may be used such that a diesel oxidation catalyst may not be required.

At the exhaust manifold 212, exhaust gas is highly pressurized and exhaust gas temperature is naturally high due to its proximate location to the combustion events. Therefore, regeneration of the DOC/DPF arrangement 255/257 may be activated without, or with minimized, additional heating thereto. Specifically, because the temperature of exhaust gas in the exhaust manifold 212 is higher, as compared to downstream of the turbocharger turbine 204, the DOC 255 may require less heating for regeneration to occur.

The filtration arrangement 255/257 may be further monitored by a filtration control system (not shown), which monitors and maintains the cleanliness of the DPF 257. In one embodiment, the control system determines and monitors the pressure differential across the DPF 257 using pressure sensors (not shown). As discussed above, the DOC/DPF 255/257 arrangement may be adapted to regenerate and oxidize soot within the DPF 257. However, if the DPF 257 is not in the form of a catalyzed partial flow diesel particulate filter, the DPF 257 will accumulate ash and some soot, which must be removed in order to maintain the DPF 257 efficiency. As ash and soot accumulate, the pressure differential across the /DPF 257 increases. Accordingly, a control system can be provided to monitor and determine whether the DPF 257 has reached a select pressure differential at which the DPF 257 requires cleaning or replacement. In response thereto, the control system may signal an indication that the DPF 257 requires cleaning or replacement. As discussed above, if the DPF 257 is in the form of a catalyzed partial flow diesel particulate filter, the DPF would not require cleaning or replacement as such a filter is designed not to accumulate ash and soot.

In one exemplary embodiment, the $NO_X$ reduction components and filtration components are individually coupled to each cylinder such that parallel flow exhaust streams are created. That is, each cylinder includes a passage or path 236 connecting it to either a DOC/DPF component arrangement 255/257 or an SCR 259 component. For example, FIG. 2B illustrates an engine 206 having 16 cylinders 225, wherein each cylinder 225 output includes a passage 236 connecting the cylinder 225 to either a DOC/DPF 255/257 component arrangement or an SCR 259 component. Regarding the SCR 259 component, upon injection of a SCR reductant fluid or SCR reagent, $NO_X$ from the exhaust reacts with the reductant fluid over the catalyst in the SCR 259 component to form nitrogen and water. Although a urea-based SCR 259 is shown, other SCRs known in the art may also be used (e.g., hydrocarbon based SCRs, solid SCRs, De-NOx systems, etc.).

The total number of DOC/DPF components 255/257 and/or SCR 259 components in the system depicted in FIGS. 2A and 2B is equal to the number of cylinders 225 in the engine 206. However, the system may be configured to provide flow from two or more adjacent cylinders through a single emission reduction component of either the $NO_X$ reducing or PM/HC/CO reducing type, if the component is constructed to have the necessary reduction capacity and flow characteristics. For example, in the SCR and DOC/DPF placement patterns as depicted in FIG. 2B, cylinders 1 and 2 and/or 14 and 15 feeding an SCR component may be configured to feed a single (augmented) SCR and the exhaust from cylinders 10, 11, 12 may similarly be combined.

The exhaust gas flows from each cylinder 225 and passes through either a DOC/DPF component 255/257 arrangement or an SCR 259 component in the embodiment of FIGS. 2A and 2B. The respective number of DOC/DPF components 255/257 and SCR 259 components may vary depending on the desired emission requirements. For instance, if it is desirable to reduce $NO_X$, more so than to reduce hydrocarbons and soot, an increased number of SCR 259 components are used and less DOC 255 components are used. In the embodiment of FIG. 2B, the system 201 includes ten (10) SCR 259 components and six (6) DOC 255 components in order to reduce $NO_X$ more than particulates and soot. In contrast, in order to reduce hydrocarbons and soot more than to reduce $NO_X$, the number DOC/DPF 255/257 components used may be increased and the number of SCR 259 components used may be reduced (not shown). By selectively altering the number of components allocated to DOC/DPF 255/257 or SCR 259, in contrast to allowing flow to pass through all components at all times, the effectiveness of the total emission reduction system 201 may be adjusted to specific desired levels.

As one skilled in the art would understand and appreciate, an increase in the number of $NO_X$ catalysts from 0 to 16 (at the same time the number of DOC catalysts decreasing 16 to 0), would cause $NO_X$ engine emissions to decrease accordingly. Generally, the effectiveness of emissions reduction devices is measured in terms of the efficiency in reducing a particular emission. Specifically, this measurement is usually a function of the inlet gas temperature and density, inlet airflow rate, volume of the component, free surface area of the catalytic surface, and the type of catalyst used. The effectiveness of an SCR device in reducing the level of $NO_X$ may be stated as the percent $NO_X$ conversion efficiency. For the depicted turbocharged locomotive two-stroke diesel engine with the presently disclosed emission reduction system, if 10 SCR catalysts and 6 DOC catalysts are used (as depicted in FIGS. 2A and 2B), $NO_X$ emissions will be about 4.3 gr/KW-hr, CO will be about 0.59 gr/KW-hr, particulate emissions will be about 0.41 gr/KW-hr, and HC emissions will be about 0.49 gr/KW-hr.

By using the SCR and DOC/DPF components in a parallel flow sequence, the amount of backpressure caused by the emissions reduction components may be significantly reduced. As a result, engine power is increased and brake specific fuel consumption (BSFC) is reduced. Moreover, by selectively altering the number of SCR and DOC/DPF components used, the emissions reduction capacity of the system may be conformed to system requirements more efficiently. This may lead to a smaller total size of the system equipment. Moreover, by using an increased number of components that are smaller in size, locomotive space may further be optimized.

Figure 3:
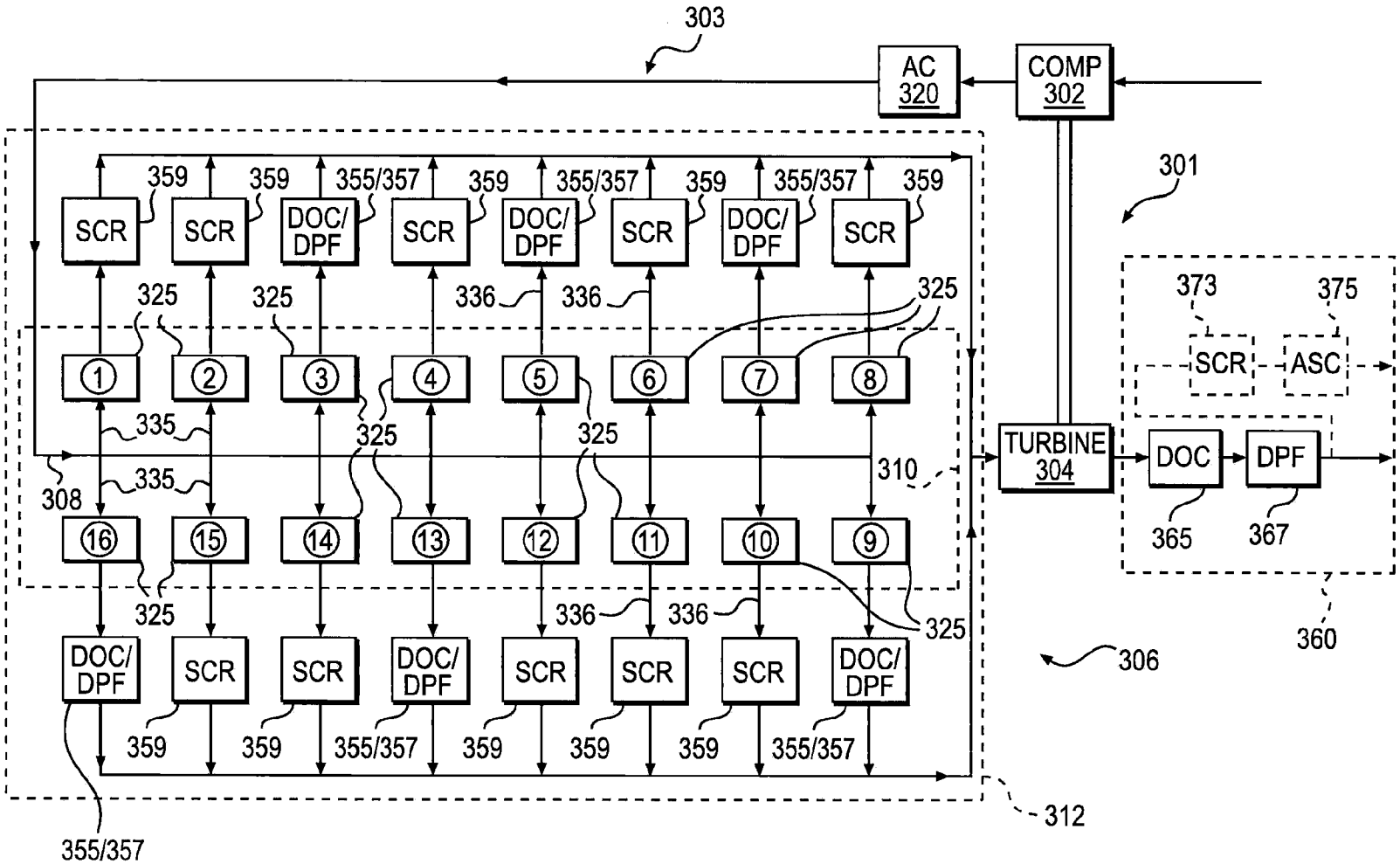
FIG. 3 is a partial exhaust gas flow diagram of a variant of the modified turbocharged engine embodiment of FIG. 2A-2B, having additional emission reduction components located downstream of the turbine, also in accordance with the presently disclosed exhaust emission reduction system.

In order to further reduce particulate emissions from the exhaust, the presently disclosed exhaust emission reduction system may include an after-treatment system situated downstream of the turbine such as depicted in FIG. 3. Components shown in FIG. 3 not specifically described but meant to have the same functions as corresponding components in FIGS. 2A and 2B have a "300" series designations instead of "200" series designations. For example, turbocharger compressor 302 shown in FIG. 3, has the same function as compressor 202 in the FIG. 2A-2B embodiment.

As illustrated in FIG. 3, after-treatment filtration system 360 may be in the form of a diesel oxidation catalyst (DOC) 365 and a catalyzed partial flow diesel particulate filter (DPF) 367 in a series flow arrangement to filter exhaust from the cylinders 325. The partial DPF 367 includes a filter to reduce PM and/or soot from the exhaust gases in the combined exhaust streams. The DOC 365 uses an oxidation process to reduce the particulate matter (PM), hydrocarbons and/or carbon monoxide emissions build-up on the DPF 367. The DOC/DPF 365/367 component arrangement may be adapted to passively regenerate and oxidize soot therein. Although a DOC 365 and DPF 367 are shown, other comparable filters may be used. As with the embodiment shown in FIGS. 2A and 2B, the filtration system 365/367 may be further monitored by a filtration control system, which would monitor and maintain the cleanliness of the DOC 365 and DPF 367.

Additionally, or alternatively, this after-treatment DOC/DPF 365/367 arrangement can include a DOC/DPF doser (not shown) e.g., a hydrocarbon injector, which adds fuel onto the catalyst for the DOC/DPF 365/367 arrangement for active regeneration of the filter if the exhaust temperature at the DPF 567 is not high enough to promote passive regeneration of the filter. Specifically, the fuel reacts with oxygen in the presence of the catalyst, which increases the temperature of the exhaust gas to promote oxidation of soot on the filter. In yet another embodiment, the after-treatment system can include an optional burner or other heating element (not shown) for heating the exhaust gas downstream of the turbine to control oxidation of soot on the filter.

In another embodiment, in order to comply with the most stringent emissions standards, after-treatment system 360 may additionally or alternatively include one or more $NO_X$ reduction components for further reducing $NO_X$ from the entire/combined exhaust stream. In the example illustrated in FIG. 3 where the $NO_X$ reduction components are included with the DOC 365 and DPF 367 components, the $NO_X$ reduction components include a selective catalytic reduction (SCR) catalyst 373 and ammonia slip catalyst (ASC) 375 (both shown by dotted lines) adapted to further lower $NO_X$ emissions of the engine 306. The SCR 373 and ASC 375 in a series flow relation to DOC 365 and DPF 367 may be further coupled to an SCR doser (not shown) for dosing an SCR reductant fluid or SCR reagent (e.g., urea-based, diesel exhaust fluid (DEF)). Upon injection of the SCR reductant fluid or SCR reagent, the $NO_X$ from the exhaust reacts with the reductant fluid over the catalyst in the SCR 373 and ASC 375 to form nitrogen and water. Although a urea-based SCR 373 is shown, other SCRs known in the art may also be used (e.g., hydrocarbon based SCRs, solid SCRs, De-$NO_X$ systems, etc.). In the FIG. 3 embodiment, the SCR 373 and ASC 375 components function to lower $NO_X$ after operation of the DOC 365 and DPF 367 components. In a variation of the FIG. 3 embodiment, the SCR 373 and ASC 375 components may be situated upstream of the DOC 365 and DPF 367 components, to lower $NO_X$ emissions prior to lowering the particulate matter (PM), hydrocarbons and/or carbon monoxide emissions.

In another embodiment, the presently disclosed exhaust emission reduction system may control the number of $NO_X$ reduction components and/or filtration components that are active in a particular engine cycle. As discussed above, and with reference again to the embodiment depicted in FIGS. 2A and 2B, the exhaust gas flows from each cylinder and passes through either a filtration component or a $NO_X$ reduction component. However, the required number of $NO_X$ reduction components and number of filtration components needed may vary depending on the desired emission reduction requirements and/or engine operating conditions. For example, in the embodiment of FIGS. 2A and 2B, and as depicted in FIG. 2A, system 270 may include a fuel injector controller 272 adapted to actively fire and/or not fire (i.e. "skip firing") the injectors 221 of particular cylinders based on whether it is desirable to preferentially reduce $NO_X$ or PM/HC/CO for a particular engine cycle or succession of cycles.

For example, if it is desirable to reduce $NO_X$ more so than to reduce hydrocarbons and soot, the controller 272 may adaptively adjust the firing of only the cylinders coupled to $NO_X$ reduction system components while possibly also increasing the fuel flow to those cylinders to maintain a desired engine power level. In this example, the controller 370 essentially stops the fuel supply to the cylinders coupled to filtration components, such that those cylinders are prevented from generating exhaust gases. As a result, only $NO_X$ is reduced in the total, overall exhaust gas stream released to the atmosphere. In another example, in order to reduce PM more than $NO_X$ while still also reducing $NO_X$, the control system may fire less than the total number of cylinders coupled to the $NO_X$ reduction components, while firing all the cylinders coupled to filtration system components. Hence, by selectively altering the number of cylinders coupled to either PM/HC/CO filtration components or $NO_X$ reduction system components that fire, in contrast to allowing fuel flow to all cylinders at all times, the effectiveness of the emission reduction system may be adjusted to a specific desired total exhaust emission reduction levels.

Industrial Applicability

As is evident from the preceding discussion, the exhaust emissions reduction system disclosed herein is useful for reducing $NO_X$ exhaust emissions and for reducing particulate emissions, hydrocarbon emissions and/or carbon monoxide emissions from the exhaust stream of an internal combustion engine. Although the exhaust emission reduction systems disclosed herein are particularly effective for two-stroke diesel engine configurations, including those having a turbocharger, they may be applied to gasoline powered engines including four-stroke engines. Moreover, the method of reducing the emissions from internal combustion engines practiced by the aforesaid disclosed system components also has equal applicability for the reduction and control of the specified exhaust emissions, which method will now be discussed.

Figure 4:
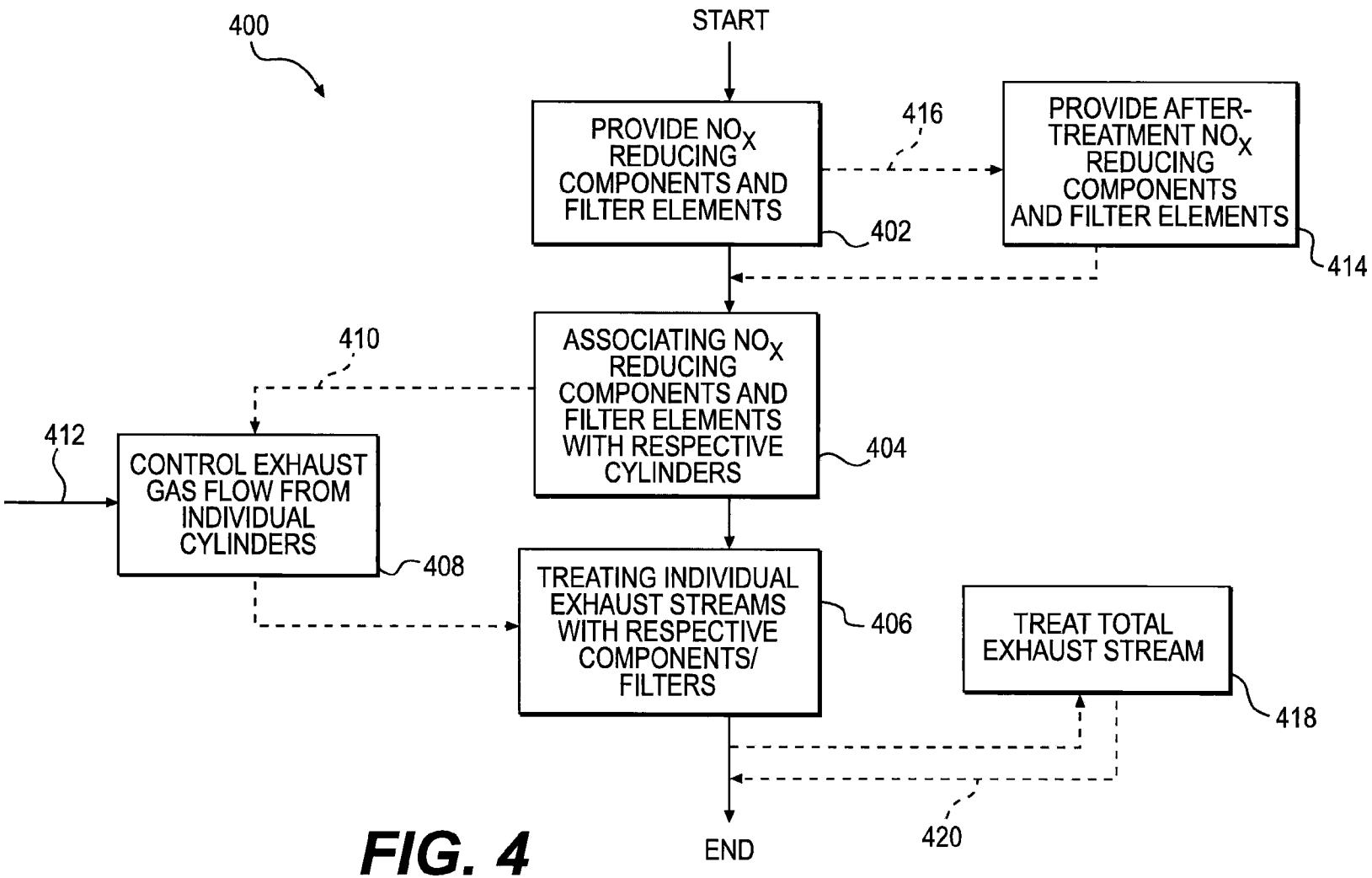
FIG. 4 is a flow schematic of a system/method for reducing emissions from an internal combustion engine.

With reference to FIG. 4, there is shown a flow diagram for the method of reducing the emissions from an internal combustion engine, which method is generally designated by the numeral 400. The method includes as an initial step 402, providing one or more components for reducing $NO_X$ emissions and one or more filtration components for reducing particulate matter, hydrocarbons, and/or carbon monoxide in the exhaust gases. As mentioned previously, the specific number of $NO_X$ emission reducing components need not be the same as the total number of particulate, hydrocarbon, and/or carbon monoxide emission reducing components, nor need the total number of both $NO_X$ reducing and filtration components be equal to the total number of cylinders, although in the previously disclosed systems the total number of $NO_X$ filtration components equals the total number of cylinders in the engine.

Method 400 next includes step 404, namely associating each of the provided $NO_X$ reducing components and filtration components to receive a flow of exhaust gases from a respective cylinder in a parallel flow arrangement. That is, and as was described previously, the exhaust gases from certain cylinders flow through $NO_X$ reducing components while the exhaust gases from other cylinders flow through filtration components to remove particular matter, hydrocarbons, and/or carbon monoxide. Importantly, the flows through the respective components and filters, which constitute flow resistances, are in parallel and not in series, whereby the resistances and therefore the pressure drops would not be additive.

The next step in the exhaust emission reduction method of 400 is step 406, treating the received individual flows of exhaust gases from the cylinders with the respective emission reducing components. However, preceeding directly to method step 406 would require that the number of $NO_X$ emissions reducing components and the number of filtration components to be unchanged, inasmuch as the components were fixed in the engine. This would entail essentially a fixed pattern or relative amount of $NO_X$ reduction relative to the amount of PM/HC/CO emission reductions from the filtration components. Consequently, for engines having fuel injectors and an associated fuel injection controller, emission reduction method 400 may alternatively include the method step 408 of controlling the generation of, and thus the flow, of exhaust gases from each individual cylinder before the treating step 406, as depicted in FIG. 4 by dotted operation sequence path 410. To cause one or more selected injectors for cylinders having either $NO_X$ reducing components or filtration components to skip firing would change the pattern of total engine emission reduction in a given engine cycle. And as would be understood by one of ordinary skill in the art given this disclosure, skipping one or more cylinders having $NO_X$ emission reduction components for treating the exhaust streams would act to increase the effect of filtration emissions components relative to the remaining $NO_X$ reducing components as compared to the predetermined pattern of emission reduction established at the time of the placement of the individual emission reduction components in the engine. One of ordinary skill in the art would also understand that the skip firing instructions to the injectors could be accomplished by the use of the injector controller via path 412 depicted in FIG. 4.

Additionally, and with continued reference to FIG. 4, the engine total treated exhaust stream that would occur after the completion of treating element 406 may be further treated to remove residual $NO_X$ and/or particulate matter, hydrocarbons, and/or carbon monoxide, such as by use of the after-treatment systems discussed previously in relation to the disclosed exhaust gas emissions reduction system. In such a case, the method 400 may preliminarily include a method step 414 of providing one or more $NO_X$ emission reducing components and/or particulate matter, hydrocarbon, and/or carbon monoxide reducing filtration components in series in an after-treatment system, to further treat the previously treated engine total exhaust stream. As shown in FIG. 4, the step 414 would generally occur concurrently with the method step 402 providing of the aforesaid individual emission reduction components for treating the individual exhaust streams received from the cylinders, as shown by concurrent (dotted) logic path 416. And thereafter, the method 400 would include the step 418 to accomplish the after-treatment of the engine total exhaust stream after step 406. This variation of the general method of reducing emissions 400 is depicted in FIG. 4 by a dotted pathway 420.

Figure 1A:
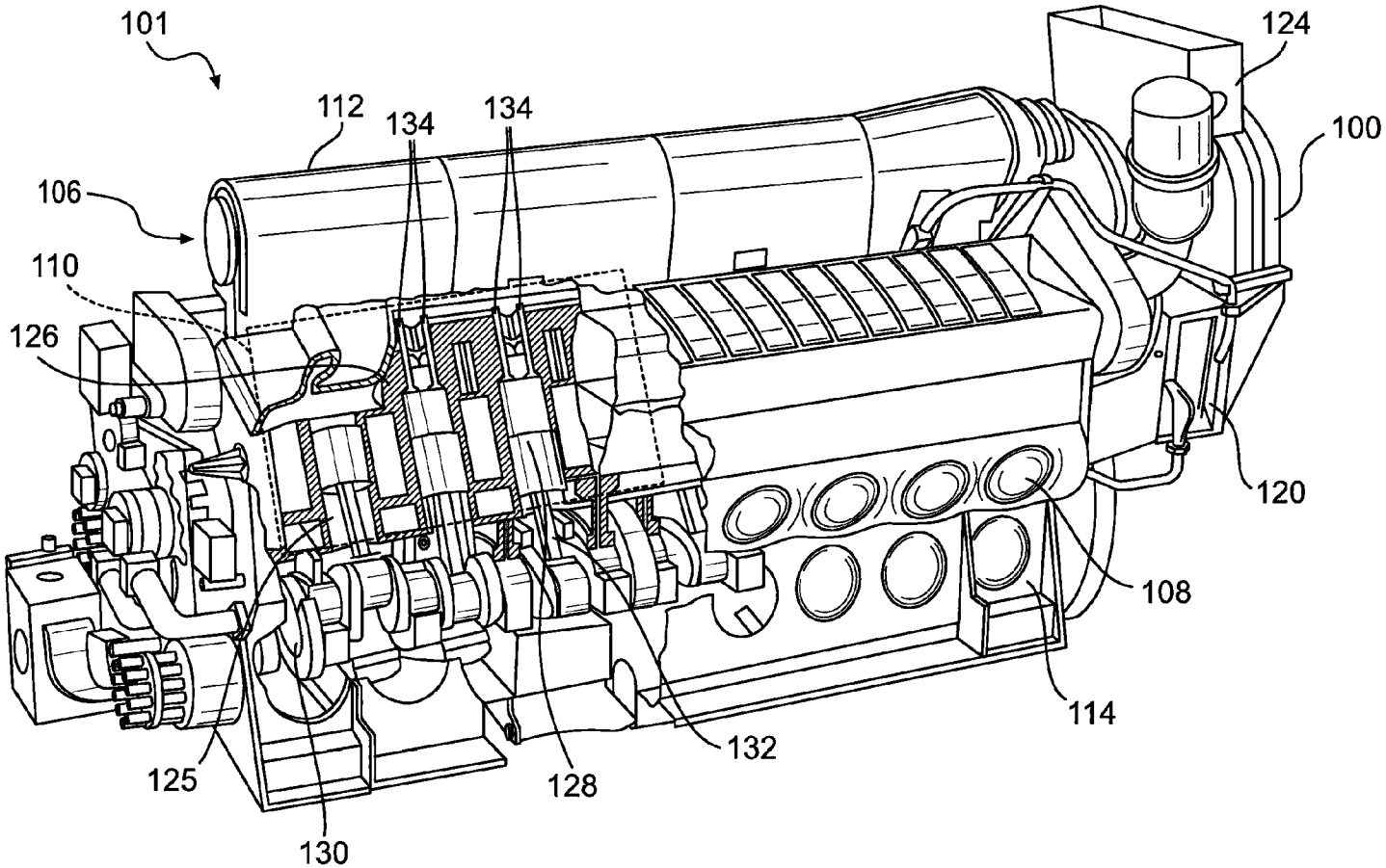
FIG. 1A is a partial cross-sectional perspective view of a conventional two-stroke, turbocharged diesel engine system suitable for a locomotive application.
Figure 1B:
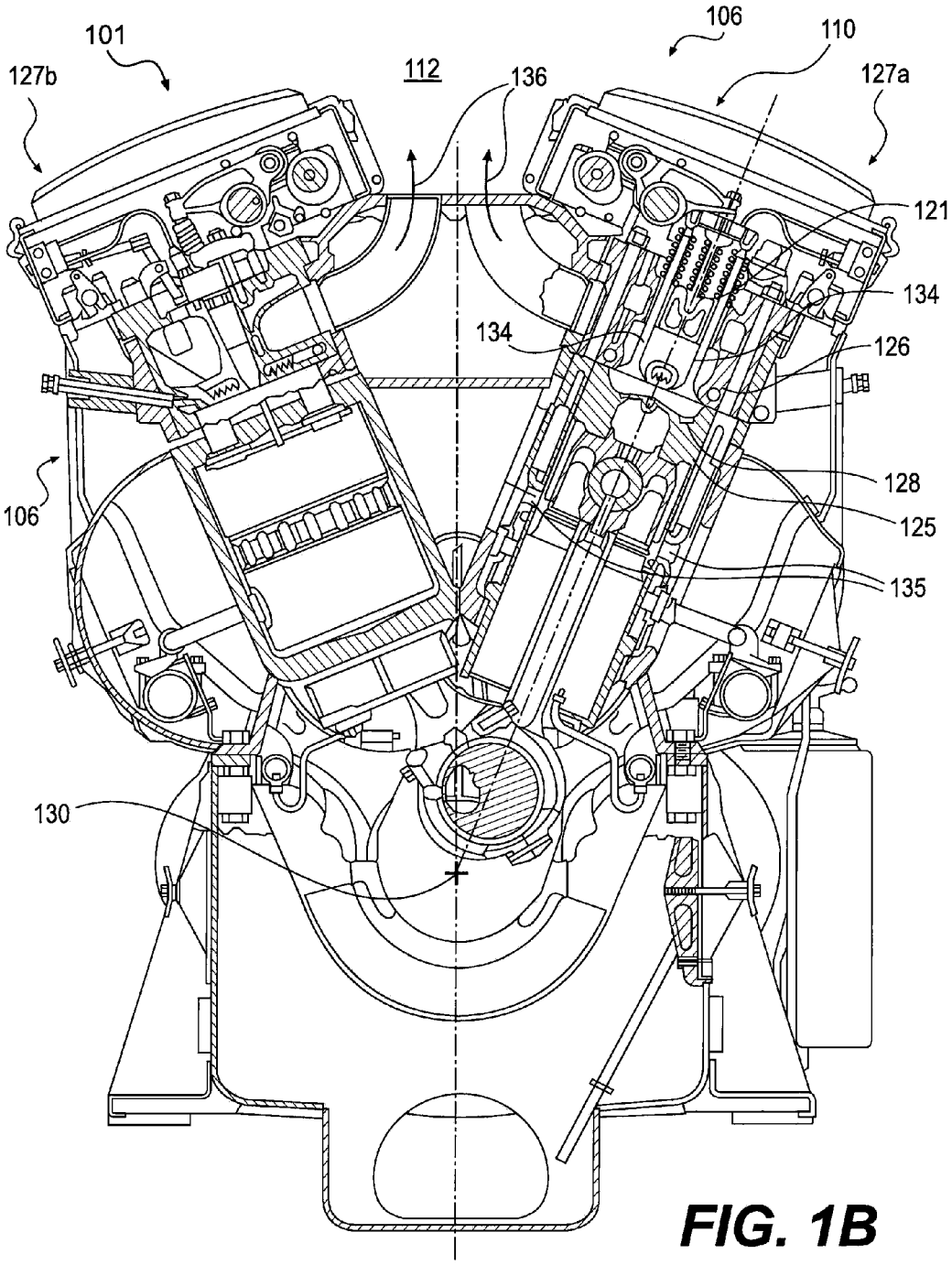
FIG. 1B is a cross-sectional axial view of the two-stroke diesel engine system of FIG. 1A.
Figure 1C:
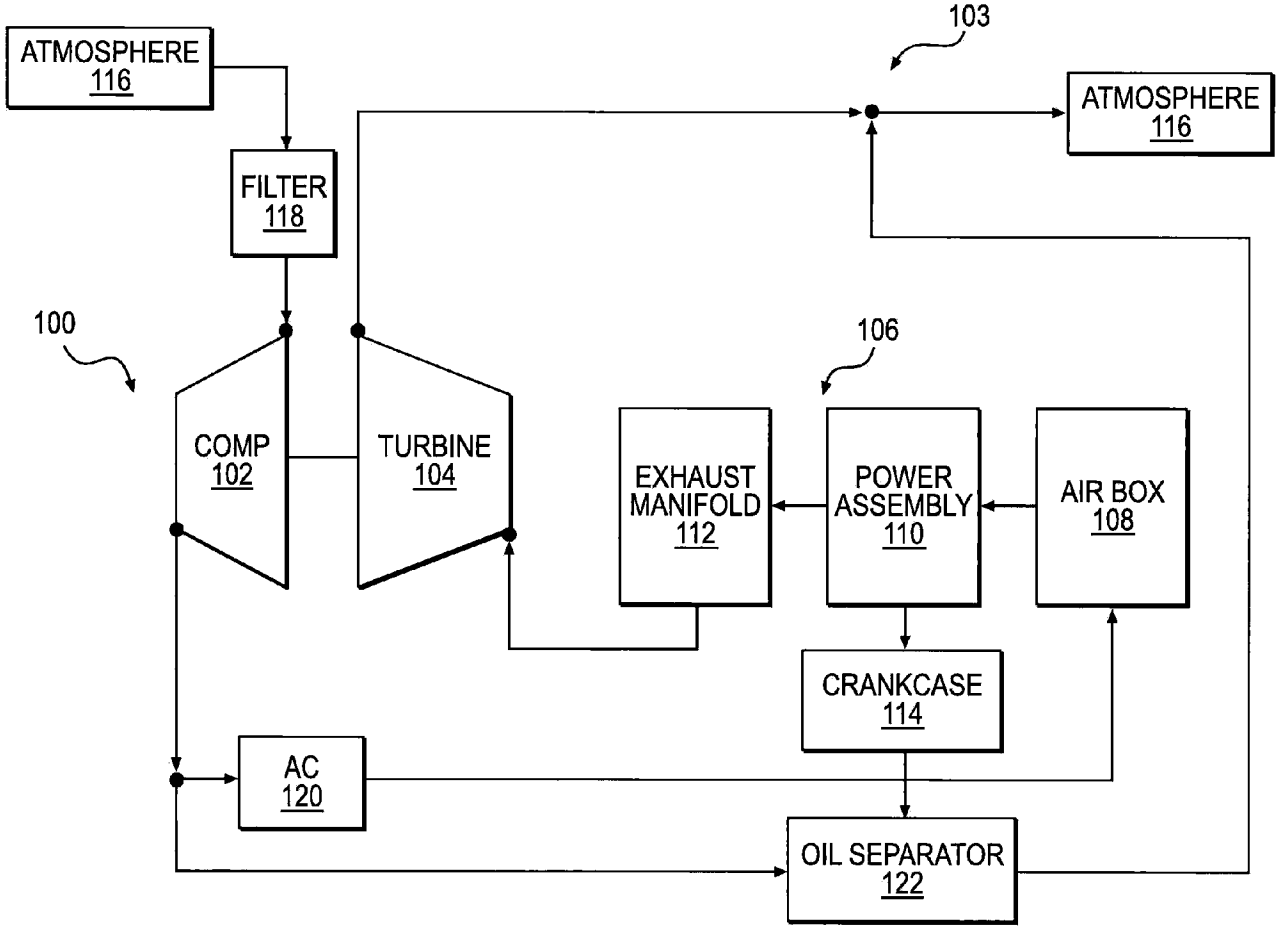
FIG. 1C is a system diagram of the air/exhaust system two-stroke diesel engine system of FIG. 1B.

The presently disclosed system for reducing engine exhaust emissions and backpressure uses a plurality of emissions reduction components arranged in a parallel flow. The emission reduction components of the presently disclosed system can be located within the engine exhaust manifold. The present system also enhances the unique scavenging and mixing processes of a locomotive uniflow fuel-injected two-stroke diesel engine in order to further reduce $NO_X$ emissions while achieving desired fuel economy, without increasing backpressure from such system. Further disclosed embodiments that include various exhaust after-treatment system components, which may be integrated into the locomotive engine system, thereby fitting within the limited size constraints of conventional locomotive engine systems such as depicted in FIGS. 1A-1C, and which are designed for ease of maintainability.

The disclosed system method may further be enhanced by adapting the various engine parameters, the exhaust gas recirculation ("EGR") system parameters, and the exhaust after-treatment system parameters to a specific application. For example, as discussed above, emissions reduction and achievement of desired fuel efficiency may be accomplished by maintaining or enhancing the scavenging and mixing processes in a uniflow two-stroke diesel engine (e.g., by adjusting the intake port timing, intake port design, exhaust valve design, exhaust valve timing, EGR system design, engine component design and turbocharger design), as one skilled in the art would understand and appreciate from the present disclosure.

The various embodiments of the present disclosure may be applied generally to fuel-injected two-stroke diesel engines having various numbers of cylinders (e.g., 8 cylinders, 12 cylinders, 16 cylinders, 18 cylinders, 20 cylinders, etc.), as well as two-stroke diesel engine applications other than for locomotive applications (e.g., marine applications, stationary power applications, etc.). Aspects of the presently disclosed exhaust emissions reduction systems may also be applied to engine systems having four-stroke engines, including gasoline-fueled engines.

While this system has been described with reference to certain illustrative aspects, it will be understood that this description shall not be construed in a limiting sense. Rather, various changes and modifications can be made to the illustrative embodiments without departing from the true spirit, central characteristics and scope of the disclosure, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

What is claimed is:

1. An exhaust emission reduction system for an internal combustion engine, the engine having a plurality of cylinders and a power assembly, each cylinder having an associated fuel injector, an inlet for receiving air for combustion with fuel within the cylinder, and an exhaust for discharging exhaust gas resulting from combustion, the emission reduction system comprising:

a plurality of emission reduction components configured to process the exhaust gas, the emission reduction components comprising $NO_X$ reduction components and filtration components configured to reduce particulate matter, hydrocarbons and/or carbon monoxide emissions; and a fuel injection controller configured to control the firing of the fuel injectors, wherein:

each engine cylinder in the plurality of cylinders is associated with a respective one of the emission reduction components, such that exhaust gas from the each engine cylinder flows through the respective one of the emission reduction components in parallel with exhaust gas flows from other cylinders in the plurality of cylinders through their respective emission reduction components, the fuel injection controller is configured to order specified fuel injectors to skip firing in one or more cylinders having a respective $NO_X$ reduction component or in one or more cylinders having a respective filtration component, the fuel injector controller is further configured to control a number of emission reduction components used in each engine cycle, and the fuel injector controller orders the specified fuel injectors to fire and the specified fuel injectors to skip firing in a desired pattern, such that either total $NO_X$ emissions or total particulate matter, hydrocarbon, and/or carbon monoxide emissions are selectively reduced.

2. The exhaust emission reduction system of claim 1, wherein the filtration components include diesel oxidation catalysts (DOC), diesel particulate filters (DPF), catalyzed DPFs and/or catalyzed partial flow DPFs.

3. The exhaust emission reduction system as in claim 1, wherein the $NO_X$ reduction components include selective catalytic reduction (SCR) catalysts and/or ammonia slip catalysts (ASC).

4. The exhaust emission reduction system as in claim 1, wherein the exhaust emission reduction system includes a different number of $NO_X$ reduction components than a number of filtration components.

5. The exhaust emission reduction system as in claim 1, wherein the engine includes an exhaust manifold, and wherein the $NO_X$ reduction components and the filtration components are positioned in the exhaust manifold.

6. The exhaust emission reduction system as in claim 1, further including an exhaust after-treatment system situated downstream of the emission reduction components, the after-treatment system including one or more additional emission reduction components for further reducing particulate matter, hydrocarbons, carbon monoxide and/or $NO_X$ emissions in an engine total exhaust stream.

7. The exhaust emission reduction system as in claim 1, wherein a total number of NOX reduction components and a total number of filtration components are set to provide a pre-determined relationship between a total engine exhaust amount of NOX reduction relative to a total engine exhaust amount of particulate, hydrocarbon and/or carbon monoxide reduction.

8. The exhaust emission reduction system as in claim 7, wherein the fuel injector controller is configured to control the firing of the fuel injectors to change the relationship.

9. The exhaust emission reduction system as in claim 6, having a plurality of additional emission reduction components arranged in a series flow configuration.

10. A method of reducing engine exhaust emissions in an internal combustion engine, the engine having a plurality of cylinders for combusting fuel with air, the combusting producing exhaust gases, the engine further including a plurality of emission reducing components including one or more components for reducing $NO_X$ emissions and one or more filtration components for reducing particulate matter, hydrocarbon, and/or carbon monoxide emissions in the exhaust gases to provide a predetermined pattern of a total engine exhaust emission reduction, the method comprising:

associating each of the provided $NO_X$ reducing components and the filtration components to receive a flow of exhaust gases from a respective cylinder in a parallel flow arrangement;

treating the received parallel flows of exhaust gases from the cylinders with the respective emission reducing components; and controlling fuel injectors in selected cylinders flowing exhaust to $NO_X$ reducing components and/or filtration components to skip firing in an engine cycle to provide a different pattern to preferentially favor $NO_X$ emission reduction or particulate matter, hydrocarbon, and/or carbon monoxide emission reduction in that cycle relative to that of the predetermined pattern.

11. The method as in claim 10, further including controlling the flow of exhaust gases generated from the cylinders in a given engine cycle by selectively firing or skip firing the respective fuel injectors, whereby no fuel is injected by the skip fired fuel injectors and thereby no exhaust gases are generated in the respective cylinders in that cycle.

12. The method as in claim 10, wherein the engine includes an exhaust manifold, and wherein the step of associating includes positioning the emission reducing components within the exhaust manifold.

13. The method as in claim 10, wherein the engine includes one or more additional $NO_X$, PM, HC, and/or CO reducing components in a series arrangement for treating a total treated exhaust stream downstream of the associated components, and the method further includes treating the total exhaust stream with the additional components.

14. An exhaust emission reduction system for a fuel injected internal combustion engine, the engine having a plurality of cylinders and a power assembly, each cylinder having an associated fuel injector, an inlet for receiving air for combustion with fuel within the cylinder, and an exhaust for discharging exhaust gas resulting from combustion, the emission reduction system comprising:

a plurality of emission reduction components configured to process the exhaust gas therein, the emission reduction components comprising $NO_X$ emission reduction components and filtration components configured to reduce particulate matter, hydrocarbons and/or carbon monoxide emissions; and a fuel injection controller configured to control the firing of the fuel injectors, wherein:

each engine cylinder in the plurality of cylinders is associated with a respective one of the emission reduction components such that exhaust gas from each engine cylinder flows through the respective one of the emission reduction components in parallel with the exhaust gas flows from other cylinders in the plurality of cylinders through respective emission reduction components, the fuel injection controller is configured to order specified fuel injectors to skip firing in one or more cylinders having a respective $NO_X$ reduction component or in one or more cylinders having a respective filtration component, a total number of $NO_X$ reduction components and a total number of filtration components are set to provide a pre-determined relationship between a total engine amount of $NO_X$ reduction relative to a total engine amount of particulate, hydrocarbon and/or carbon monoxide reduction, and the fuel injector controller is configured to control the firing of the fuel injectors to change the relationship.

15. The exhaust emission reduction system of claim 14, wherein the filtration components include diesel oxidation catalysts (DOC), diesel particulate filters (DPF), catalyzed DPFs and/or catalyzed partial flow DPFs.

16. The exhaust emission reduction system as in claim 14, wherein the $NO_X$ reduction components include selective catalytic reduction (SCR) catalysts and/or ammonia slip catalysts (ASC).

17. The exhaust emission reduction system as in claim 14, wherein the exhaust emission reduction system includes a different number of $NO_X$ reduction components than a number of filtration components.

18. The exhaust emission reduction system as in claim 14, wherein the engine includes an exhaust manifold, and wherein the $NO_X$ reduction components and the filtration components are positioned in the exhaust manifold.

19. The exhaust emission reduction system as in claim 14, further including an exhaust after-treatment system situated downstream of the emission reduction components, the after-treatment system including one or more additional emission reduction components for further reducing particulate matter, hydrocarbons, carbon monoxide and/or $NO_X$ emissions in an engine total exhaust stream.

20. The exhaust emission reduction system as in claim 19, having a plurality of additional emission reduction components arranged in a series flow configuration.

* * * * *